US005927350A

United States Patent [19]

Kissinger, Jr.

[11] Patent Number: 5,927,350

[45] Date of Patent: Jul. 27, 1999

[54] SYSTEM FOR PREVENTING SPILLAGE FROM CONTAINERS DURING FILLING THEREOF

[75] Inventor: George Thomas Kissinger, Jr., Kansas City, Mo.

[73] Assignee: Customized Transportation Inc., Jacksonville, Fla.

[21] Appl. No.: 09/020,006

[22] Filed: Feb. 6, 1998

Related U.S. Application Data

[60] Provisional application No. 60/037,195, Mar. 6, 1997.

[51] Int. Cl.[6] ..... B67D 5/06

[52] U.S. Cl. ..... 141/198; 141/1; 141/94; 141/95; 141/192; 141/208; 141/210; 141/216; 141/220; 141/351; 141/231; 141/382; 141/389; 141/346

[58] Field of Search ..... 141/1, 94–96, 141/192, 198, 206–208, 210, 216–223, 227, 231, 346, 351, 352, 382, 387–389

[56] References Cited

U.S. PATENT DOCUMENTS

| | | | |
|---|---|---|---|
| 3,042,084 | 7/1962 | Boone et al. | 141/225 |
| 3,085,600 | 4/1963 | Briede | 141/209 |
| 3,328,789 | 6/1967 | Pacheco . | |
| 3,590,890 | 7/1971 | Young | 141/192 |
| 3,662,924 | 5/1972 | Crandall et al. | 222/64 |
| 3,863,147 | 1/1975 | Erath . | |
| 3,905,243 | 9/1975 | Goldfuss | 73/295 |
| 4,447,743 | 5/1984 | Bean et al. | 307/118 |
| 4,449,405 | 5/1984 | Franz et al. | 73/304 C |
| 4,480,251 | 10/1984 | McNaughton et al. | 340/604 |
| 4,522,237 | 6/1985 | Endo et al. | 141/95 |
| 4,530,384 | 7/1985 | Boyes | 141/95 |
| 4,567,762 | 2/1986 | Hoppert et al. | 73/304 R |
| 4,593,275 | 6/1986 | Kazandjoglou | 340/604 |
| 4,780,705 | 10/1988 | Beane | 340/620 |
| 4,915,145 | 4/1990 | Schirmacher | 141/95 |
| 5,085,258 | 2/1992 | Fink, Jr. et al. | 141/207 |
| 5,141,019 | 8/1992 | LeBlanc et al. | 137/423 |
| 5,285,812 | 2/1994 | Morales | 137/393 |
| 5,349,994 | 9/1994 | Koeninger | 141/94 |
| 5,404,923 | 4/1995 | Yamamoto et al. | 141/94 |
| 5,438,323 | 8/1995 | Shea | 340/620 |
| 5,445,192 | 8/1995 | Hansen | 141/231 |
| 5,460,210 | 10/1995 | Koeninger | 141/94 |
| 5,507,326 | 4/1996 | Cadman et al. | 141/198 |
| 5,515,890 | 5/1996 | Koeninger | 141/94 |

*Primary Examiner*—J. Casimer Jacyna
*Attorney, Agent, or Firm*—Pillsbury Madison & Sutro Intellectual Property Group

[57] ABSTRACT

A system for preventing spillage from containers during the filling thereof includes an electrical circuit extending between one or more filling ports of the container and being connected with one or more liquid level sensitive switches within the container. A liquid dispensing apparatus for dispensing liquid into the container is coupled to the circuit so as to be enabled to dispense liquid into the container when the circuit is closed and to be disabled from dispensing liquid into the container when the circuit is opened. The circuit includes electrically isolated leads at each of the one or more filling ports that can be connected with each other so as to complete the circuit at that port when either the filling port is properly capped or the liquid dispensing apparatus is properly coupled to the port. The one or more liquid level sensitive switches complete the circuit as long as the level of the liquid within the tank is below a prescribed limit level and open the circuit when the level of the liquid within the container is at or above the prescribed level. The liquid level sensitive switches are preferably installed at vent openings of the container, and embodiments of the liquid level sensitive switches also function as shut-off valves to prevent liquid from escaping from the container through the vent openings when the tank is tipped over.

24 Claims, 6 Drawing Sheets

SYSTEM FOR PREVENTING SPILLAGE FROM CONTAINERS DURING FILLING THEREOF

This application claims the benefit of prior filed provisional application Ser. No. 60/037,195, filed Mar. 6, 1997.

BACKGROUND OF THE INVENTION

1. Field of the Invention

The present invention relates to a system which prevents spilling from containers during filing thereof, and, more particularly, to a system which disables a fluid dispensing apparatus when either the container into which the apparatus is to dispense fluid is full or if one or more caps for closing filing apertures in the container are not in place.

2. Description of the Related Prior Art

When filling a tank with a spillable substance, for example, a liquid, spilling can occur when the tank is overfilled by dispensing too much of the spillable substance into the tank so that the substance exits from apertures in the tank, such as filling and/or venting apertures. In addition, spilling can occur when one or more apertures in the tank, other than the aperture through which the tank is being filled, are not properly capped, or otherwise closed off, to contain the substance in the tank so that during filling of the tank, the substance is able to leak out of the uncapped aperture(s).

Problems presented by inadvertent spillage during filling operations can be particularly acute in the case of diesel-powered train locomotives.

Because of the large capacities of the fuel tank of most locomotives (typically 1000–5000 gallons) it is desirable to dispense fuel into the tank at high volume rates so as to fill the tank as expeditiously as possible. Present fuel dispensing apparatuses dispense fuel at rates ranging from 150 to 350 gallons/minute, and future systems may dispense fuel at rates of up to 600 gallons/minute. In addition, diesel locomotives tanks typically have multiple filler openings so as to accommodate filling from either or both sides of the tank and may also include one or more air vent openings disposed near the top of the tank to allow air into and out of the tank.

If the tank is being filled at one filler opening and another filler opening is not properly capped, fuel can exit the uncapped opening while being dispensed into the tank. Alternatively, if the level of the fuel in the tank reaches the top of the tank, fuel can exit from one or more of the air vent openings. The problem of spillage in train locomotives is exasperated by the fact that railroad tracks are typically not completely level and one side and/or end of the tank may be disposed at a lower position than an opposite side and/or end of the tank. Accordingly, during a filling operation, fuel may reach the level of a lower filler opening before it reaches the level of the opening at which the tank is being filled.

Due to the high volume rates at which fuel is typically dispensed into a locomotive fuel tank, any spillage which occurs during the refueling process can result in substantial quantities of fuel being spilled upon the ground, thus posing safety, health, and environmental hazards.

Typically, spilling is avoided by nozzles with automatic shut-offs and/or by fuel gauges or view windows provided in tanks which permit operators to visually monitor fuel level in the tank. Neither method, however, monitors whether all unused filler openings are capped and neither method accounts for tank tilt. That is, if a nozzle with an automatic shut-off capability is being used at one filler neck and a different, uncapped filler neck is disposed at a lower position than the nozzle due to tank tilt, fuel may reach and exit the uncapped filler neck before the level in the tank reaches the automatic shut-off sensor of the nozzle. In addition, automatic shut-offs may sometimes malfunction. Fuel gauges are often broken due to the harsh environment in which a locomotive operates and is serviced. View windows often become occluded by dirt, snow, or other debris or even by diesel fuel staining so as to become non-functional. In addition, a gauge or view window may also suffer from the same disadvantages as an automatic shut-off nozzle if an uncapped filler neck is disposed below the gauge or window due to tank tilt. Moreover, monitoring fuel level through a view window by a gauge inherently requires the vigilance of an operator, which may not be reliable if the operator is inattentive or becomes distracted.

Various systems have been proposed in the prior art literature for automatically avoiding spillage during the filling of a liquid container.

For example U.S. Pat. Nos. 5,349,994; 5,460,210; and 5,515,890 to Koeninger disclose a system for preventing the overfilling of tanks, especially fuel trailer tanks. The system includes top sensors and bottom sensors provided in each compartment of a multi-compartment fuel tank. The bottom sensors indicate whether there is retained fluid within the tank/compartment, and the top sensors indicate whether the tank is full. When both sensors give a dry signal, fuel dispensing equipment is enabled so that the tanks may be filled. When the bottom sensor is wet, the sensor is automatically or manually overridden so that dispensing may be continued. The top sensors disable the dispensing system when the tank is full. The bottom sensors indicate whether there is retained fluid in the tank so that an operator will know if the tank can accept the full tank capacity amount of fluid. Accordingly, the system disclosed in the Koeninger patents determines whether fluid is retained in the tank before a dispensing operation commences and shuts down the dispensing equipment when the tank is full. The system does not, however, provide any protection in the situation in which a tank having multiple filling openings has openings which are not properly capped or coupled to a fluid-dispensing apparatus.

U.S. Pat. No. 4,915,142 to Schirmacher discloses a monitoring system for filling containers which includes an electrically conductive connecting line connected in series with a measuring device disposed in the container. The connecting line is connected to the tank opening by means of a connecting line flange coupled to a tank opening flange and the line is connected to a pipeline by means of a connecting line flange coupled to a pipeline flange. The interflange connections are electrically insulating connections so that the electrically conductive line is insulated from both the tank and the pipeline. Impedance bridges are provided over the interflange connections to prevent static charge build-up. The measuring device is preferably a cold line system which goes through an impedance change when fluid in the tank reaches the device.

The device and line are electrically connected to a monitoring device which in turn is in operative connection with a control device that actuates a shut-off element. When the tank is not full and no malfunctions are detected along the hose line, the control device opens a shut-off element to permit fluid-dispensing. Dispensing commences until a change in system impedance due to fluid level reaching the measuring device or due to a malfunction along the connection hoses is detected by the monitoring device which sends a signal to the control device which closes the shut-off element. Again, the system proposed in Schirmacher '142 includes no protection to ensure that filling apertures are properly capped or coupled to a dispensing apparatus.

SUMMARY OF THE INVENTION

It is a goal of the present invention to overcome the disadvantages which accompany prior art systems for preventing spills. Accordingly, the system of the present invention prevents accidental spillage by monitoring the amount of substance in a container so that overfilling is prevented and by ensuring that all apertures through which inadvertent spillage may occur are properly capped or otherwise closed off and enabling or disabling a dispensing apparatus in response to the status of the container.

Therefore, the present invention provides a system for preventing spillage from a liquid container during the filling thereof. The container includes one or more filling ports, each of which may be closed by an associated filler cap. The liquid container is filled by a dispensing apparatus having one or more filler port coupling devices to couple the dispensing apparatus to at least one of the filling ports. The system comprises a dispenser apparatus controlling circuit constructed and arranged to enable the dispensing apparatus to dispense liquid into the liquid container when the dispensing apparatus is properly coupled to at least one filling port, all unused filling ports are properly capped, and the amount of liquid in the tank is below a prescribed limit. The dispenser apparatus controlling circuit is constructed and arranged to disable the dispensing apparatus to prevent the dispensing apparatus from dispensing liquid into the liquid container when either one or more unused filling ports are uncapped or the liquid container contains at least the prescribed amount of liquid.

More specifically, in a preferred embodiment, the invention provides a spill-preventing container system comprising a container including at least one filling port which includes cap engaging structure. A filler cap is associated with each filling port, and each filler cap has filling port engaging structure constructed and arranged to be engaged with the cap engaging structure of each filling port to couple the filler cap with the filling port. A liquid dispensing apparatus can be selectively engaged with the cap engaging structure to couple the liquid dispensing apparatus with the filling port to permit the liquid dispensing apparatus to dispense liquid into the container.

The system further includes at least one liquid level sensitive switch which provide an electrically conductive path therethrough when a liquid level within the container is below a prescribed liquid level limit and to inhibit electrical flow therethrough when the liquid level within the container is at or above the prescribed liquid level limit.

A dispenser apparatus controlling circuit comprises an electrically conductive path operatively coupled with the liquid dispensing apparatus to enable the liquid dispensing apparatus to dispense liquid into the container when the electrically conductive path is closed and to disable the liquid dispensing apparatus from dispensing liquid into the container when the electrically conductive path is opened. The electrically conductive path includes a filling port portion associated with each filling port. Each filling port portion comprises electrically isolated contacts which constitute an opening in the electrically conductive path and which can be electrically connected with one another to close the opening in the electrically conductive path when a filler cap is coupled with the filling port or when the liquid dispensing apparatus is coupled with the filling port. Each liquid level sensitive switch constitutes a portion of the electrically conductive path to close the electrically conductive path when the liquid level within the container is below the prescribed limit and to open the electrically conductive path when the liquid level within the container is at or above the prescribed limit.

Other objects, features, and characteristics of the present invention will become apparent upon consideration of the following description and the appended claims with reference to the accompanying drawings, all of which form a part of the specification, and wherein like reference numerals designate corresponding parts in the various figures.

DETAILED DESCRIPTION OF THE INVENTION

Figure 1:
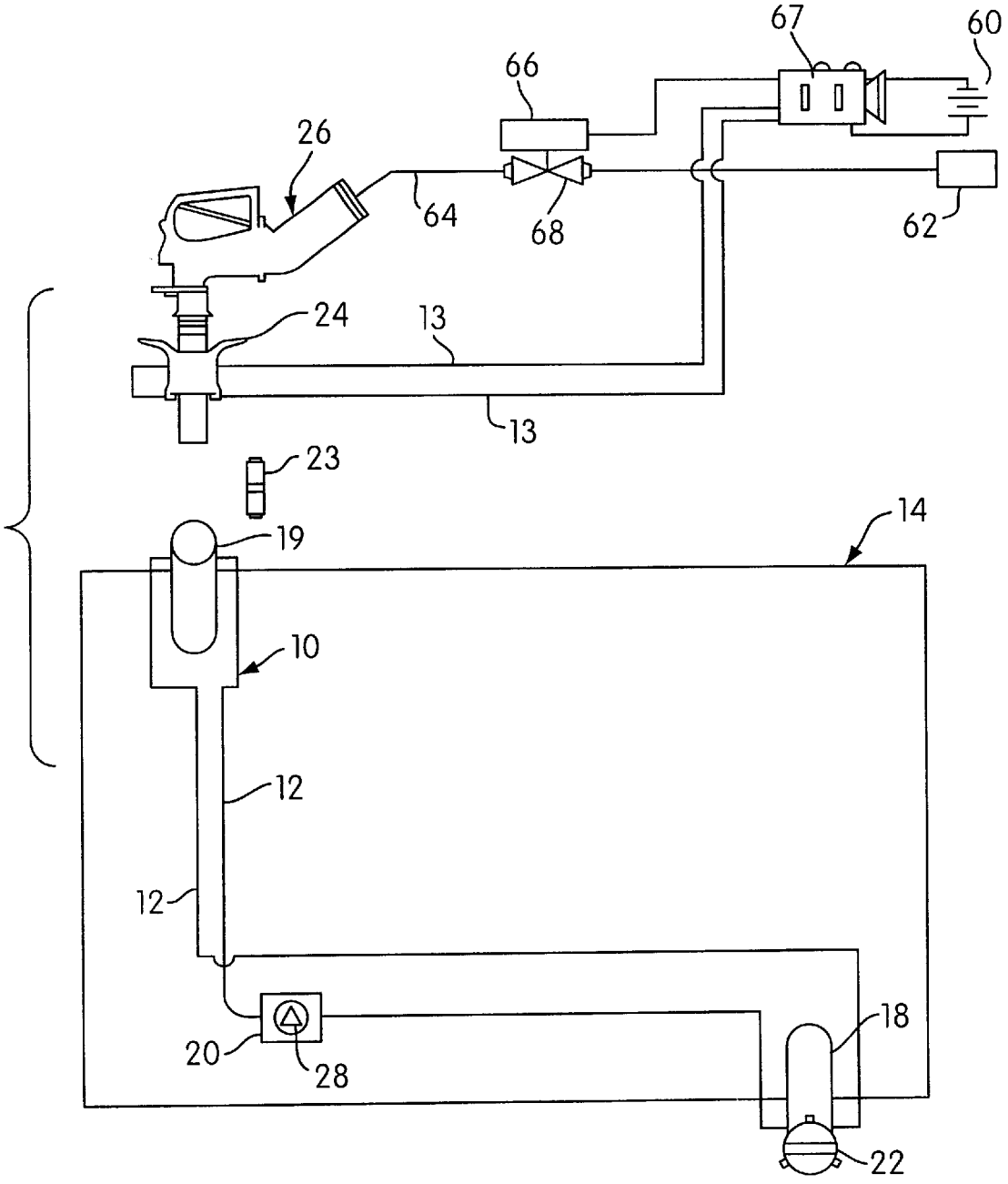
FIG. 1 is a schematic view of a fluid container and dispensing apparatus equipped with a spill-preventing system according to the present invention.

A system according to the present invention is represented schematically in FIG. 1. FIG. 1 depicts a schematic top view of a tank 14 incorporating a system according to the present invention. Tank 14 may represent, for example, the diesel fuel tank of a train locomotive. The tank 14 may include one or more filler necks, typically located proximate an upper portion of the tank. In the illustrated embodiment, tank 14 includes two filler necks 18, 19 located proximate diagonally opposed corners of the tank. Further, in the illustrated embodiment, filler neck 18 is capped by a filler cap 22, and filler neck 19 is coupled to a dispensing apparatus, such as dispensing nozzle 26, for purposes of filling the tank 14. A second filler cap 23 is associated with filler neck 19 but is removed from filler neck 19 while disposing nozzle 26 is coupled to filler neck 19.

Although tank 14 is shown having two filler necks 18, 19, each located on opposites sides of the tank 14, it is not uncommon, especially in train locomotive fuel tanks, to have more than one filler neck per side of the tank. Accordingly, the fuel tank system shown in FIG. 1 is intended to be representative and descriptive and not limiting. In addition, while the tank 14 illustrated in FIG. 1 is shown coupled to a single dispensing nozzle 26 for purposes of filling the tank, it is not uncommon, again especially in train locomotive applications, to couple more than one dispensing nozzle to different filler necks of the tank simultaneously so as to hasten filling of the tank.

Tank 14 may also include one or more air vents 20, located at an upper portion of the tank, usually above the point where the filler neck enters the tank. The purpose of the vents 20 is to permit air to flow into or out of the tank so that air can displace liquid being consumed from the tank or air in the tank can be displaced by liquid entering the tank.

Dispensing nozzle 26 may be coupled to filler neck 19 of tank 14 in a conventional manner by coupling collar 24 in a manner to be described in more detail below. Also, dispensing nozzle 26 may be coupled by appropriate hosing to a mobile filing apparatus (e.g., a fuel truck) or it may be coupled to a stationary filling station.

The spillage prevention system of the present invention comprises an electric circuit 10 extending about selected areas of the tank 14. The circuit 10 is comprised of a suitable conducting path, preferably insulated fourteen or sixteen gage wire, represented by reference number 12, which extends from one filler neck 18 to the other filler neck 19 and back to the first filler neck 18. It is presently contemplated that wire 12 will be housed in a protective conduit, such as, for example, copper or other metal tubing. The protective conduit housing wire 12 is fixedly secured to the outside of the fuel tank.

Circuit 10 preferably includes a twelve volt DC power source. Where the dispensing nozzle is attached to a fuel truck, the power source will be the truck's twelve volt DC power supply. On the other hand, if the dispensing nozzle is attached to an AC powered stationary filling station, a supply of AC current at the station is preferably converted to twelve volts DC for use in the circuit 10.

Dispensing nozzle 26 is enabled to pump liquid, e.g., fuel, into tank 14 only when the circuit 10 is complete, or closed. If the circuit 10 is open, dispensing nozzle 26, or the apparatus supplying liquid to the nozzle 26, is disabled so as to prevent nozzle 26 from dispensing liquid into the tank if the dispensing of liquid has not yet commenced or terminate the dispensing of liquid from nozzle 26 if the dispensing is in progress.

The circuit 10 extends through each filler neck 18, 19 and is completed across the filler neck by a properly installed filler neck cap 22 or a properly coupled dispensing nozzle 26 as will be described. It can be appreciated that if additional filler necks were provided on the tank 14, other than the two filler necks 18, 19 shown in FIG. 1, the circuit would also extend through those filler necks and would be completed at those filler necks by either a properly installed filler neck cap or a properly coupled dispensing nozzle. Accordingly, the dispensing nozzle or nozzles is/are enabled to dispense liquid into the tank 14 only when every filler neck of the tank is either properly capped or properly coupled with a dispensing nozzle. Therefore, inadvertent spillage caused by dispensing liquid into one filler neck while another filler neck is uncapped or by dispensing liquid when the dispensing nozzle is improperly coupled with the filler neck is prevented.

Consistent with the broader aspects of the present invention, any container aperture can be incorporated into circuit 10 so that dispensing of a spillable substance into the container can be controlled by the closed or unclosed status of the aperture. It is not always necessary, however, to incorporate all container apertures into the circuit 10. In the presently contemplated application of the present invention to locomotive diesel tanks, for example, it may not be necessary to ensure that the air vents are closed because the air vents are located above the filler necks, and spillage would occur, if at all, at the filler neck before it would occur at the air vent. In addition, the system 10 of the present invention includes means for disabling the dispensing apparatus when the tank is full, as will be described below.

Accordingly, circuit 10 preferably also includes one or more liquid level sensitive switches 28 which complete the circuit until the level of the liquid in the tank 14 at the liquid level sensitive switch 28 reaches a certain cut-off level. In the preferred embodiment of the present invention, two liquid level sensitive switches are provided at diagonally opposed corners of the tank so as to account for liquid level variations due to fore and aft and/or left and right tilting of the tank.

The cut-off level at which the liquid level sensitive switch opens the circuit 10, and thus disables the dispensing nozzle (s), is preferably below a level at which the liquid in the tank begins to enter the liquid filler neck 18, 19, which may extend into the interior of the tank 14. Accordingly, it can be appreciated that as the tank 14 is being filled, the circuit 10 will be opened, and thus dispensing nozzle 26 will be disabled, when the liquid in the tank reaches either of the liquid filler necks 18 or 19 so as to prevent liquid spillage due to overfill.

Figure 2:
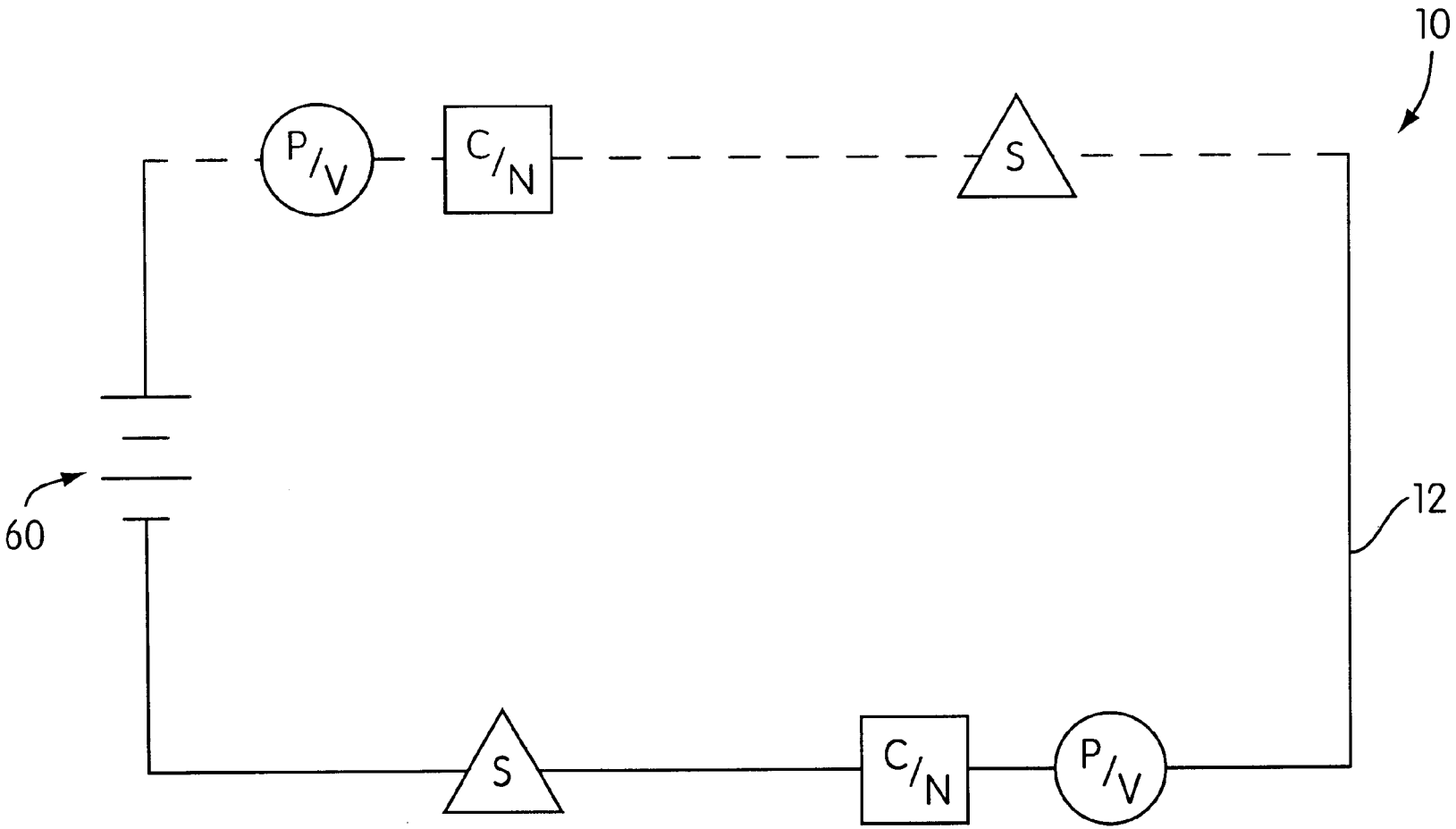
FIG. 2 is a circuit diagram schematically illustrating the principles of the system of the present invention.

FIG. 2 is a circuit diagram illustrating the principles of the present invention. The circuit 10 includes a power source 60, which, as described above, is preferably a twelve volt DC supply.

The symbol "S" represents a liquid level sensitive switch. Switch "S" does not disrupt the circuit 10 when the level of the liquid at the switch is below a cut-off level.

The symbol "C/N" represents a filler neck, or aperture, at which either a cap or a dispensing apparatus, or nozzle, is coupled with the filler aperture.

The cap or nozzle "C/N" does not disrupt the circuit 10 when the cap or nozzle is properly coupled with the filler neck.

The symbol "P/V" represents an apparatus or device, such as a liquid pump or a solenoid valve, that causes or allows liquid to flow from a nozzle. There may be an apparatus or device "P/V" associated with each nozzle, as shown, or there may be one apparatus or device that controls all nozzles. The device "P/V" allows or causes liquid to flow from a nozzle when current flows through the device. The device "P/V", may, for example, be a solenoid valve which cuts off hydraulic fluid flow to a hydraulically powered pump when current to the valve is cut off. Alternatively, the device "P/V" may be an electrically powered switch which cuts off power to an electric pump when power to the electrically powered switch is cut off. Alternatively, the device "P/V" may be a solenoid valve in the nozzle or nozzle line which closes and cuts off liquid flow from the nozzle when power to the valve is cut off.

In the system shown in FIG. 1, for example, lines 13 run from the coupling collar 24 of the dispenser 26 to a junction box 67, which controls an actuator 66 which in turn controls a valve 68 disposed within the line 64 extending from a fuel pump 62 to the nozzle 26.

As can be appreciated, if none of the switches "S" or the caps and/or nozzles "C/N" is "off" so that current flows through the circuit 10, the nozzle(s) will be allowed or caused by the nozzle control device(s) "P/V" to dispense liquid into a tank. If, however, one or more switches "S" and/or one or more caps and/or nozzles "C/N" is "off", current flow through the circuit 10 is disrupted and the control device(s) "P/V" will disable the nozzle(s).

One portion of the circuit 10 of FIG. 2 is shown as a dashed line. This is to indicate that fewer or additional switches "S", caps or nozzles "C/N", and pumps or valves "P/V" may be incorporated into the control circuit 10 of the present invention than are shown in FIG. 2, depending on the configuration of the tank and the filling apparatus.

In the preferred embodiment of the present invention, the liquid level sensitive switches used are float switches, manufactured by the Madison Company, part number 2A553. A float switch mounted inside a fuel tank is schematically shown in FIG. 6.

Figure 6:
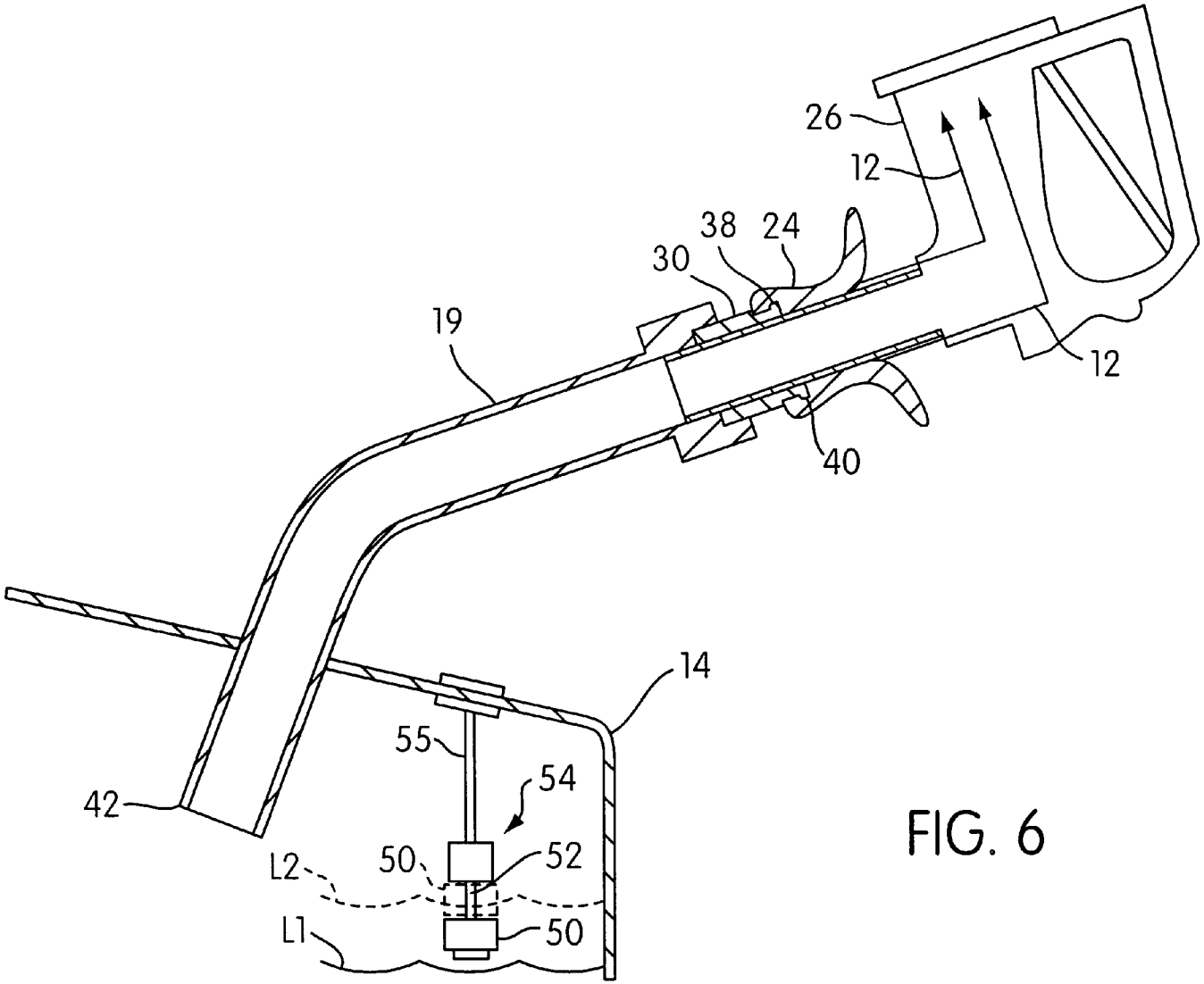
FIG. 6 is a partial view, partially in cross-section, of a fuel tank, filler neck, dispensing nozzle, and liquid level sensor switch assembly incorporating aspects of the system of the present invention.

As shown in FIG. 6, float switch 54 may be suspended from the top of the tank 14 by a structure 55 which also houses wires extending to and from the switch 54. Float switch 54 includes a float element 50 slidably supported on a float shaft 52. In a manner well known in the art, when the liquid in the tank is at level L1 below the float element 50, float element 50 rests in its lowermost position on float shaft 52. In this position, the float switch is "on", i.e., it does not disrupt the circuit 10. When the liquid in the tank reaches a higher level L2, shown in phantom, float element 50 moves along float shaft 52 to its uppermost position also shown in phantom. At its uppermost position, the switch is "off", i.e., it disrupts the circuit 10, and dispensing nozzle 26 is disabled. Note that the level L2 at which the float switch 54 will cut off the circuit 10 is preferably below a terminal end 42 of the filler neck 19 extending into the interior of the tank 14.

Other devices which may be used as liquid level sensitive switches include, for example, liquid level sensitive thermistors and optic sensors, both of which will open the circuit 10 when the liquid level at the switch has reached a cutoff level and both of which are well known in the art.

Figure 8:
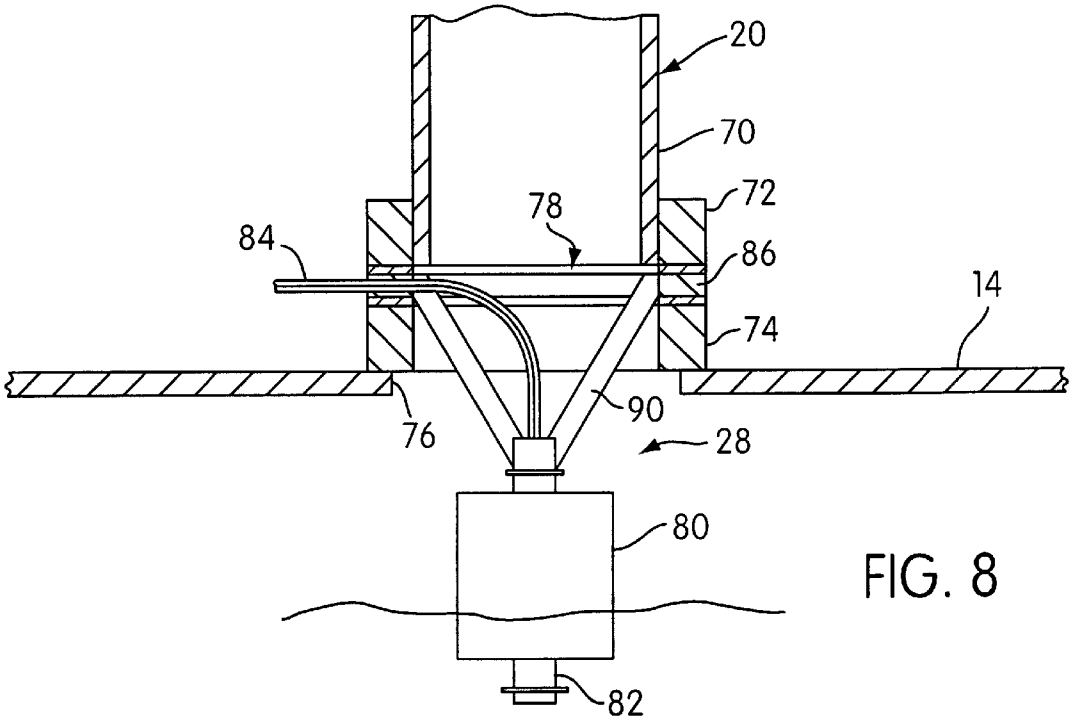
FIG. 8 is a cross section of the liquid level sensing switch assembly of FIG. 7 viewed in the direction "VIII—VIII"
Figure 7:
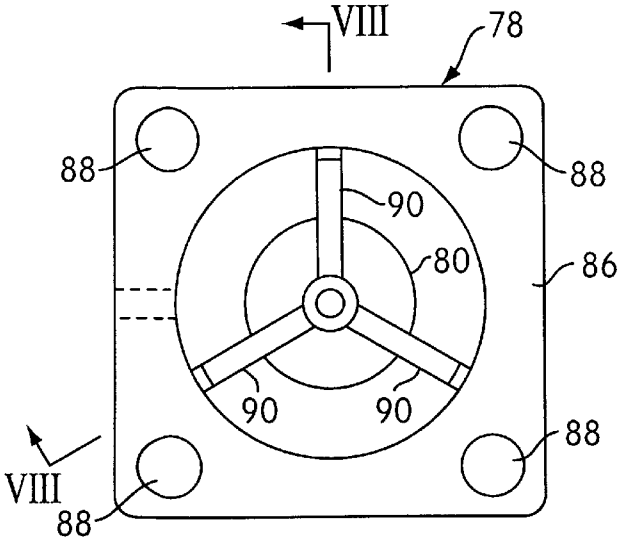
FIG. 7 is a top view of an alternate embodiment of a liquid level sensing switch assembly.

Installation of the float switch assembly shown in FIG. 6 can be rather invasive in that it requires that installation holes me formed in the tank through which the switch assembly can be installed. Accordingly, a more preferable arrangement is one in which the fluid level sensor and associated mounting structure is incorporated at the vent openings already provided in the tank. An example of such an assembly is shown in FIGS. 7 and 8. As shown, a float switch assembly 28 is installed at the vent opening 20. The assembly 28 includes a mounting structure 78 comprising a mounting flange 86 which is preferably rectangular in shape and includes a plurality of mounting holes 88 formed therein and a reverse, or inverted, tripod structure in the form of three circumferentially spaced radial spokes 90 extending downwardly from the mounting flange 86. The float switch mounting structure 78 is installed by sandwiching the mounting flange 86 between a tank flange 74 and a vent pipe flange 72, to which is attached a vent pipe 70, and securing the assembly by means of mechanical fasteners such as screws or bolts. Accordingly, it can be appreciated that the float switch assembly 28 can be retrofitted into a tank 14 without the need for forming additional holes or otherwise damaging the tank.

The float switch itself comprises a float 80 slidably disposed on a float post 82 and from which extends a pair of wires 84 which would be connected into the control system circuit 10. In all other respects, the float switch operates conventionally.

If a tank has more than one vent, a float switch assembly 28 is preferably installed in each vent, especially if the vents are located on opposite ends and/or sides of the tank, to account for liquid level variations due to tank tilt.

Figure 9:
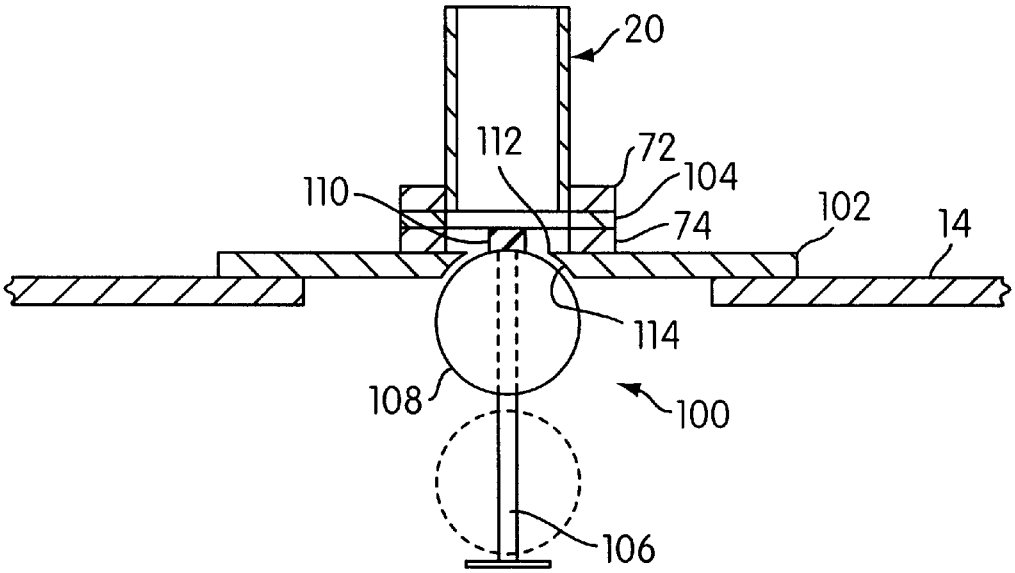
FIG. 9 is a side view, partially in cross section, of an alternate embodiment of a liquid level sensing switch assembly.
Figure 10:
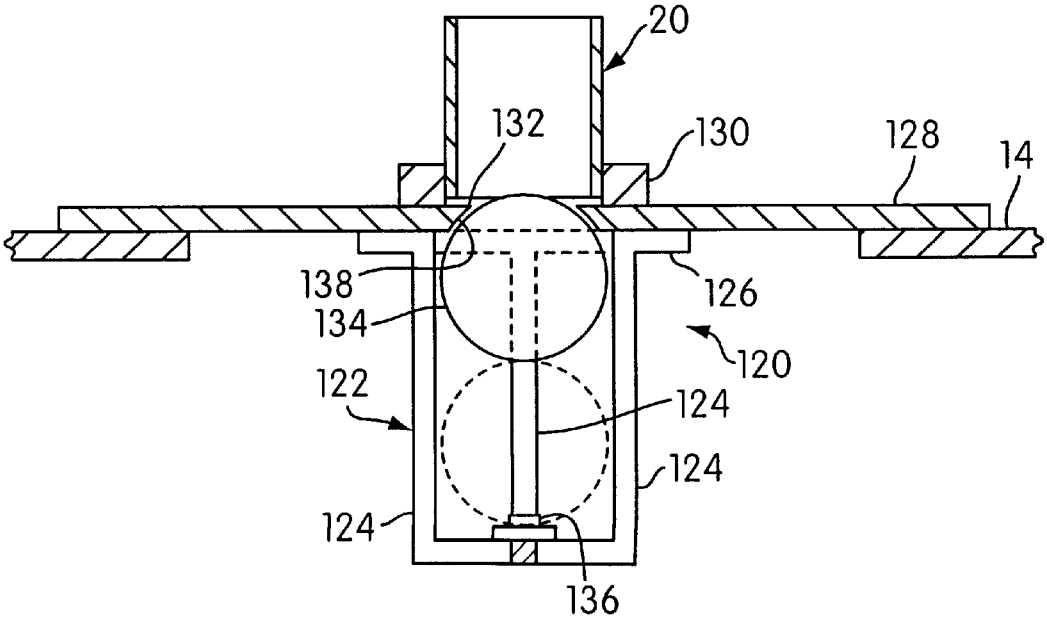
FIG. 10 is a side view, partially in cross section, of an alternate embodiment of a liquid level sensing switch assembly.

Alternate float switch embodiments are shown in FIGS. 9 and 10.

One of the dangers which can accompany a train derailment in which a locomotive tips onto its side is that fuel stored in the locomotive fuel tank can leak out of the vent opening(s), thus creating fire and environmental hazards. Accordingly, the present inventor has developed a float switch assembly which also serves as a vent opening cutoff valve should the train locomotive tip over onto its side.

The first embodiment of a float switch/cut-off valve is shown in FIG. 9. A spherical float 108 is slidably disposed on a float post 106. The float post 106 extends downwardly from a mounting flange 104 which is mounted between a tank flange 74 and a vent pipe flange 72, to which the vent pipe 20 is attached. The float post 106 extends down through a beveled opening 114. The float switch 100 operates in a conventional manner except that when the tank is tipped on its side or, for some other reason, excessive upward liquid pressure is applied to the float switch, the spherical float element 108 will engage the beveled opening 114 to effectively close off the opening 114 thus preventing fuel from exiting the opening. A gasket element 110, preferably made of an elastomeric material, may be provided at the upper end of the float post 106 so as to prevent fuel from seeping out through the post accommodating opening formed through the float element 108.

For the float element 108 to be operable to prevent fluid from escaping through the opening, it is obviously necessary that the float element 108 be larger than the opening 114. Accordingly, to install such a float switch into a tank, it may be necessary to enlarge the existing vent opening and install a float switch assembly which is pre-assembled to a mounting plate 102 by securing the mounting plate 102 to the tank wall at the enlarged opening.

An alternate embodiment of a float switch/cut-off valve is shown in FIG. 10. The float switch 120 shown in FIG. 10 comprises a spherical float element 134 disposed within a float cage 122 which comprises a number of circumferentially spaced vertical elements 124 extending from an annular mounting flange 126. A contact switch 136 may be provided at the bottom end of the cage 122 which is contacted by the float element 134 when the fluid level is below the float element 134. When the tank 14 is tipped on its side or upward liquid pressure is otherwise exerted, the float element 134 moves up to engage the beveled opening 138 to effectively close off the opening 138 and prevent the exiting of fluid therethrough. Because the float element 134 is not disposed on a float post as in the embodiment shown in FIG. 9, there is no hole formed through the float element 134 and thus, there is reduced opportunity for leakage around or through the float element. The float switch 120 is preferably pre-assembled to a mounting plate 128 which is secured to the walls of the tank 14.

In addition to the float-type switches described above, overfill may be prevented in some applications by monitoring the amount of substance in the container, rather than the level of the substance in the container. Accordingly, in such applications, any device which monitors the amount of substance in the tank so that the dispensing apparatus can be disabled before the amount of substance in the container exceeds the capacity of the tank as defined by the location of the filling aperture relative to the container would function satisfactorily in the system of the present invention.

Figure 3:
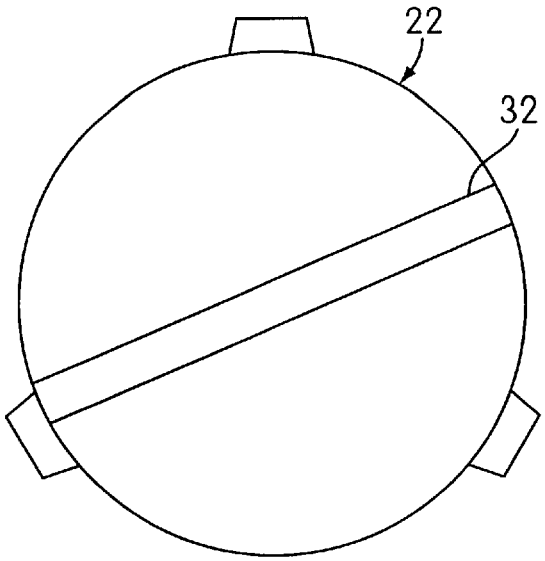
FIG. 3 is a top plan view of a filler neck cap incorporating aspects of the system of the present invention.
Figure 4:
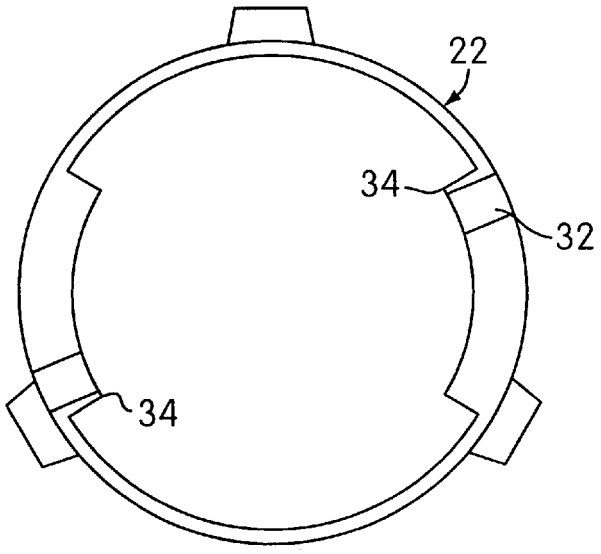
FIG. 4 is a bottom plan view of the filler neck cap incorporating aspects of the system of the present invention.
Figure 5:
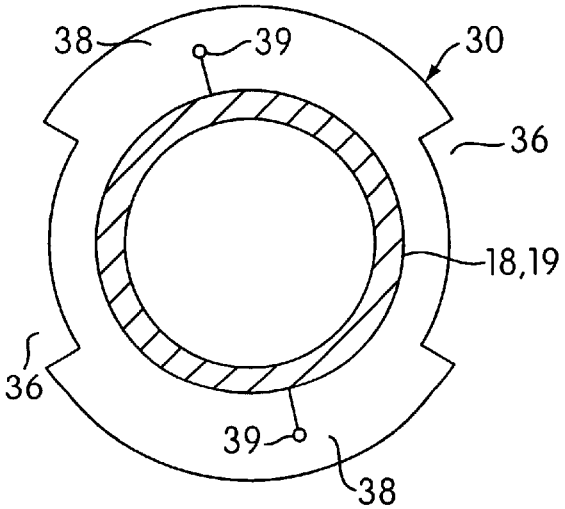
FIG. 5 is a cross section of a filler neck viewed up the neck toward a cap-engaging collar.

The preferred manner of completing the circuit at a filler neck with a fuel filler cap is shown in FIGS. 3–5. Cap 22 preferably includes a connecting strap 32 which is comprised of a highly conductive material, such as aluminum, and extends diametrically across the top of the cap 22 as shown in FIG. 3. In train locomotive applications, because the cap itself is typically constructed of a poorly conducting material, the connecting strap 32 is desirable.

Cap 22 may be of a conventional form having radially extending inner flanges 34 which engage corresponding peripheral openings 36 formed in the collar 30 of the filler neck. As shown in FIG. 4, the connecting strap 32 is electrically connected to diametrically opposed flanges 34. The strap extends across the bottom of flanges 34 and the ends of the strap extend up over the top of flanges 34 inside the cap 22.

In the illustrated embodiment, the wires of the circuit 12 extend up the filler neck to isolated contact points 39 disposed beneath the outwardly extending radial flange 38 of the filler neck collar 30. When the cap 22 is properly installed on the collar 30 of the filler neck, that is, when inner flanges 34 are passed through peripheral openings 36 of collar 30 and the cap 22 is twisted with respect to the collar 30 so that the flanges 34 extend beneath the outer flange 38 so as to secure the cap 22 to the collar 30, the connecting strap 32 provides an electrical connection between the isolated contacts 39 located below the outer peripheral flange 38 of the collar 30.

The coupling of the dispensing nozzle 26 with the filler neck 19 of tank 14 is shown in FIG. 6. The liquid dispensing nozzle 26 may comprise any commercially available dispensing nozzle adapted for use with the particular tank 14, or other container, being used. A typical nozzle system employed for fueling train locomotives is the Snyder II Fueling System manufactured by Snyder Equipment of Nixa, Mo., which is described in U.S. Pat. No. 3,042,084, the disclosure of which is hereby incorporated by reference.

The nozzle system includes the dispensing nozzle 26 and a coupling collar 24 adapted to couple the nozzle 26 to the collar 30 of the filler neck 19. As described above, the wires of the control circuit may extend up the filler neck 19 and terminate at isolated contact points 39 below the coupling flanges 38 of the collar 30. The coupling collar 24 includes corresponding flanges 40 which mate with flanges 38 of filler neck collar 30 to securely couple the coupling collar 24 and the dispensing nozzle 26 to the filler neck 19.

The coupling collar 24 is modified by providing connecting brushes in the flanges 40 of the coupling collar 24 which engage the isolated contacts in the flanges 38 of the filler neck collar 30. Wires 12 extend from the brushes to a device that causes or allows the dispensing nozzle 26 to dispense liquid, such an electric switch or solenoid valve which controls a liquid pump or the dispensing nozzle, as described above. As can be appreciated, the dispensing nozzle will not be enabled to dispense liquid into the tank 14 if the dispensing nozzle is not properly coupled with the filler neck 19.

The embodiments described above, in which the filler neck connections are automatically made and broken by installing and removing a cap or dispenser nozzle, are preferred. The connections may be made however, by means of independent connector elements wherein the connector elements, such as male and female plug elements, are separately coupled to one another to complete the circuit when a cap or nozzle is installed on the filler neck and are separately uncoupled when the cap or nozzle is removed.

While the invention has been described in connection with what is presently considered to be the most practical and preferred embodiments, it is to be understood that the invention is not to be limited to the disclosed embodiment, but, on the contrary, it is intended to cover various modifications and equivalent arrangements included within the spirit and scope of the appended claims. Thus, it is to be understood that variations in the particular parameters used in defining the present invention can be made without departing from the novel aspects of this invention as defined in the following claims.

What is claimed is:

1. A system for preventing spillage from a liquid container during the filling thereof, the container including at least two filling apertures, each of the at least two filling apertures being selectively closable by an associated filler cap, the liquid container being selectively filled by a dispensing apparatus having at least one filling aperture coupling device constructed and arranged to selectively couple the dispensing apparatus to at least one of the at least two filling apertures when the at least one filling aperture is not closed by an associated filler cap, said system comprising a dispenser apparatus controlling circuit constructed and arranged to:

(1) enable the dispensing apparatus to dispense liquid into the liquid container when:

(a) the dispensing apparatus is coupled to the at least one filling aperture by the at least one filling aperture coupling device, (b) any filling apertures of the at least two filling apertures to which the dispensing apparatus is not coupled by a filling aperture coupling device are closed by an associated filler cap, and (c) the liquid container contains less than a prescribed amount of liquid, and (2) disable the dispensing apparatus to prevent the dispensing apparatus from dispensing liquid into the liquid container when either:

(a) any one of the at least two filling apertures is not coupled to the dispensing apparatus by a filling aperture coupling device and is not closed by an associated filler cap, or (b) the liquid container contains at least the prescribed amount of liquid.

2. The system of claim 1, wherein said dispenser apparatus controlling circuit comprises an electrically conductive path operatively coupled with the dispensing apparatus to enable the dispensing apparatus to dispense liquid into the container when said electrically conductive path is closed and to disable the dispensing apparatus from dispensing liquid into the container when said electrically conductive path is opened.

3. The system of claim 2, wherein said electrically conductive path includes a filling aperture portion associated with each of the at least two filling apertures, each said filling aperture portion comprising electrically isolated contacts which constitute an opening in said electrically conductive path and which can be electrically connected with one another to close said opening in said electrically conductive path when the filling aperture is closed by the associated filler cap or when the dispensing apparatus is coupled with the filling aperture.

4. The system of claim 3 wherein each associated filler cap includes a connecting strap extending across said filler cap which engages each of said electrically isolated contacts of said electrically conductive path when said filler cap is coupled with said filling aperture so as to electrically connect said electrically isolated contacts with one another.

5. The system of claim 2, wherein said dispenser apparatus controlling circuit comprises at least one liquid level sensitive switch constructed and arranged to provide an electrically conductive path therethrough when a liquid level within the container is below a prescribed liquid level limit and to inhibit electrical flow therethrough when the liquid level within the container is at or above the prescribed liquid level limit, said at least one liquid level sensitive switch comprising a portion of said electrically conductive path to close said electrically conductive path when the liquid level within the container is below the prescribed limit and to open said electrically conductive path when the liquid level within the container is at or above the prescribed limit.

6. The system of claim 5 wherein each of said at least one liquid level sensitive switch comprises a float switch.

7. The system of claim 5 wherein the container includes at least one vent opening formed therein and wherein said at least one liquid level sensitive switch is installed proximate at least one of said at least one vent opening.

8. The system of claim 7 wherein each of said at least one liquid level sensitive switch comprises a float switch mounted on a switch mounting structure, said switch mounting structure comprising a mounting flange connected to a wall of the container proximate said vent opening and an inverted tripod structure extending downwardly from the wall into an interior space of the container.

9. The system of claim 7 wherein each of said at least one liquid level sensitive switch comprises a float switch mounted on a switch mounting structure, said float switch including a stopper float constructed and arranged to be movable into a sealing position with respect to said vent opening so as to substantially prevent liquid contained in the container from escaping the container through said vent opening when the container is disturbed from an upright orientation.

10. The system of claim 7 wherein said stopper float is substantially spherical in shape and wherein a portion of said container wall surrounding said vent opening is beveled to at least partially conform to the spherical shape of said stopper float.

11. The system of claim 7 comprising a one of said at least one liquid level sensitive switch installed proximate each of said at least one vent opening.

12. The system of claim 5 comprising two liquid level sensitive switches, each being disposed proximate opposite ends of the liquid container from each other.

13. A method for preventing spillage of liquid from a liquid container during filling of the liquid container, the liquid container including at least two filling apertures, each of the at least two filling apertures being selectively closable by an associated filler cap, the container being selectively filled by a liquid dispensing apparatus having at least one filling aperture coupling device constructed and arranged to selectively couple the liquid dispensing apparatus to at least one of the at least two filling apertures when the at least one filling aperture is not closed by an associated filler cap, said method comprising:

monitoring whether each filling aperture of said at least two filling apertures is either closed by an associated filler cap or coupled to the dispensing apparatus by a filling aperture coupling device;

monitoring the amount of liquid in the liquid container;

enabling the liquid dispensing apparatus to dispense liquid into the container if each filling aperture is either closed by an associated filler cap or coupled to the liquid dispensing apparatus by a filling aperture coupling device and the amount of liquid in the container is below a prescribed limit; and disabling the liquid dispensing apparatus to prevent the liquid dispensing apparatus from dispensing liquid into the container if any filling aperture is not closed by an associated filler cap or coupled to the liquid dispensing apparatus by a filling aperture coupling device or if the amount of liquid in the container is at or above the prescribed limit.

14. A system for preventing spillage of a spillable substance from a container during filling of the container with the spillable substance, the container including at least two filling apertures, each of the at least two filling apertures being selectively closable by an associated filler cap constructed and arranged to be closingly coupled with each filling aperture, the container being selectively filled with the spillable substance by a dispensing apparatus constructed and arranged to dispense the spillable substance and having filling aperture coupling devices constructed and arranged to selectively couple the dispensing apparatus to at least one of the at least two filling apertures when the at least one filling aperture is not closed by an associated filler cap, said system comprising: a dispensing apparatus controlling circuit constructed and arranged to (1) enable the dispensing apparatus to dispense the spillable substance into the container if each filling aperture is either closed by an associated filler cap or coupled to the dispensing apparatus by a filling aperture coupling device and the amount of spillable substance in the container is below a prescribed limit and (2) disable the dispensing apparatus to prevent the dispensing apparatus from dispensing any additional spillable substance into the container if any filling aperture is not closed by an associated filler cap or coupled to the dispensing apparatus by a filling aperture coupling device or if the amount of spillable substance in the container is at or above the prescribed limit.

15. A spill-preventing container system, said container system comprising:

a container for holding a liquid, said container including at least two filling ports defining at least two filling apertures in communication with an interior space of said container, each of said at least two filling ports including cap engaging structure, wherein said container is capable of being selectively filled with the liquid by a liquid dispensing apparatus, the liquid dispensing apparatus being selectively engagable with said cap engaging structure to couple the liquid dispensing apparatus with at least one of said filling ports to permit the liquid dispensing apparatus to dispense liquid through said filling aperture into said container;

a filler cap associated with each of said at least two filling ports, each filler cap having filling port engaging structure constructed and arranged to be selectively engaged with said cap engaging structure of said filling port to couple said filler cap with said associated filling port for selectively closing off said filling aperture of said associated filling port with said filler cap;

at least one liquid level sensitive switch constructed and arranged to provide an electrically conductive path therethrough when a liquid level within said container is below a prescribed liquid level limit and to inhibit electrical flow therethrough when the liquid level within said container is at or above the prescribed liquid level limit; and a dispenser apparatus controlling circuit comprising an electrically conductive path operatively coupled with the liquid dispensing apparatus to enable the liquid dispensing apparatus to dispense liquid into said container when said electrically conductive path is closed and to disable the liquid dispensing apparatus from dispensing liquid into said container when said electrically conductive path is opened, said electrically conductive path including a filling port portion associated with each of said at least two filling ports each said filling port portion comprising electrically isolated contacts which constitute an opening in said electrically conductive path and which can be electrically connected with one another to close said opening in said electrically conductive path when a filler cap is coupled with said filling port or when the liquid dispensing apparatus is coupled with said filling port, said at least one liquid level sensitive switch constituting a portion of said electrically conductive path to close said electrically conductive path when the liquid level within said container is below the prescribed limit and to open said electrically conductive path when the liquid level within said container is at or above the prescribed limit.

16. The spill-preventing container system of claim 15 wherein each of said at least one liquid level sensitive switch comprises a float switch.

17. The spill-preventing container system of claim 15 wherein each filler cap includes a connecting strap extending across said filler cap which engages each of said electrically isolated contacts of said electrically conductive path when said filler cap is coupled with said filling port so as to electrically connect said electrically isolated contacts with one another.

18. The spill-preventing container system of claim 17 wherein each of said electrically isolated contacts is disposed on said cap engaging structure of said filling port and wherein said connecting strap terminates at opposite ends thereof on said filling port engaging structure so that said connecting strap connects said isolated contacts with one another when said filling port engaging structure of said cap is engaged with said cap engaging structure of said filling port to couple said cap to said filling port.

19. The spill-preventing container system of claim 15 comprising two liquid level sensitive switches, each being disposed proximate opposite ends of said container from each other.

20. The spill-preventing container system of claim 15 wherein said container includes at least one vent opening formed therein and wherein said at least one liquid level sensitive switch is installed proximate at least one of said at least one vent opening.

21. The spill-preventing container system of claim 20 wherein each of said at least one liquid level sensitive switch comprises a float switch mounted on a switch mounting structure, said switch mounting, structure comprising a mounting flange connected to a wall of said container proximate said vent opening and an inverted tripod structure extending downwardly from said wall into said interior space of said container.

22. The spill-preventing container system of claim 20 wherein each of said at least one liquid level sensitive switch comprises a float switch mounted on a switch mounting structure, said float switch including a stopper float constructed and arranged to be movable into a sealing position with respect to said vent opening so as to substantially prevent liquid contained in said container from escaping said container through said vent opening when said container is disturbed from an upright orientation.

23. The spill-preventing container system of claim 22 wherein said stopper float is substantially spherical in shape and wherein a portion of said container wall surrounding said vent opening is beveled to at least partially conform to the spherical shape of said stopper float.

24. The spill-preventing container system of claim 20 comprising a one of said at least one liquid level sensitive switch installed proximate each of said at least one vent opening.

* * * * *